US009981275B2

(12) United States Patent
Mackel et al.

(10) Patent No.: US 9,981,275 B2
(45) Date of Patent: May 29, 2018

(54) SEPARATOR WITH DIRECT DRIVE AND COOLANT SYSTEM INTEGRATED INTO DRIVE HOUSING

(71) Applicant: GEA Mechanical Equipment GmbH, Oelde (DE)

(72) Inventors: Juergen Mackel, Oelde (DE); Dieter Strauch, Oelde (DE); Johannes Droste, Rosendahl (DE)

(73) Assignee: GEA Mechanical Equipment GmbH, Oelde (DE)

( * ) Notice: Subject to any disclaimer, the term of this patent is extended or adjusted under 35 U.S.C. 154(b) by 417 days.

(21) Appl. No.: 14/442,064

(22) PCT Filed: Nov. 6, 2013

(86) PCT No.: PCT/EP2013/073117
§ 371 (c)(1),
(2) Date: May 11, 2015

(87) PCT Pub. No.: WO2014/072318
PCT Pub. Date: May 15, 2014

(65) Prior Publication Data

US 2015/0283561 A1 Oct. 8, 2015

(30) Foreign Application Priority Data

Nov. 12, 2012 (DE) ..... 10 2012 110 846

(51) Int. Cl.
*B04B 9/04* (2006.01)
*B04B 9/12* (2006.01)
(Continued)

(52) U.S. Cl.
CPC ..... *B04B 15/02* (2013.01); *B04B 9/02* (2013.01); *B04B 9/04* (2013.01); *B04B 9/12* (2013.01); *B04B 15/00* (2013.01)

(58) Field of Classification Search
CPC B04B 15/02; B04B 15/00; B04B 9/02; B04B 9/04; B04B 9/12
(Continued)

(56) References Cited

U.S. PATENT DOCUMENTS 2,597,405 A * 5/1952 Tholl ..... B04B 9/12 384/368
3,257,235 A * 6/1966 Steele ..... B04B 9/12 127/19
(Continued)

FOREIGN PATENT DOCUMENTS

DE 513 192 C 11/1930
DE 570 729 C 2/1933
(Continued)

OTHER PUBLICATIONS

PCT/EP2013/073117, International Search Report dated Jul. 30, 2014 (Three (3) pages).
(Continued)

*Primary Examiner* — Charles Cooley
(74) *Attorney, Agent, or Firm* — Crowell & Moring LLP

(57) ABSTRACT

A separator includes: a centrifugal drum; a drive spindle, where the drive spindle is rotatably mounted in a drive housing by a neck bearing and a foot bearing, and where the drive housing encloses a drive chamber; an electric motor which has a stator and a motor rotor, where the motor rotor is disposed on the drive spindle, where the stator is fixedly connected to the drive housing, where an air gap exists between the stator and the motor rotor, and where the stator and the motor rotor are arranged between the neck bearing and the foot bearing; a lubricating system for lubrication of the neck bearing and the foot bearing; and a coolant system; where the stator has a flange section which is disposed on a collar section of the drive housing.

17 Claims, 2 Drawing Sheets

(51) Int. Cl.
*B04B 15/02* (2006.01)
*B04B 9/02* (2006.01)
*B04B 15/00* (2006.01)

(58) Field of Classification Search
USPC ..... 494/15
See application file for complete search history.

(56) References Cited

U.S. PATENT DOCUMENTS

| | | | | | |
|---|---|---|---|---|---|
| 3,318,644 | A * | 5/1967 | Johnson, III | F16C 33/6659 | 184/31 |
| 3,604,769 | A | 9/1971 | Latham, Jr. | | |
| 4,322,030 | A | 3/1982 | Jacobson et al. | | |
| 4,652,782 | A | 3/1987 | Rossie | | |
| 4,946,433 | A * | 8/1990 | Gorodissky | B04B 9/02 | 184/31 |
| 5,848,959 | A * | 12/1998 | Droste | B04B 9/12 | 184/6.18 |
| 5,980,222 | A * | 11/1999 | Fry | F04B 39/0055 | 184/6.18 |
| 6,117,063 | A * | 9/2000 | Szepessy | B04B 9/12 | 384/467 |
| 6,228,016 | B1 * | 5/2001 | Kristensen | B04B 9/12 | 384/467 |
| 6,267,204 | B1 * | 7/2001 | Kristensen | B04B 9/12 | 184/6.12 |
| 6,527,085 | B1 * | 3/2003 | Paczuski | F04B 39/0246 | 184/6.16 |
| 6,578,670 | B1 * | 6/2003 | Klintenstedt | B04B 9/12 | 184/6.16 |
| 6,626,814 | B1 * | 9/2003 | Setterberg | B04B 9/08 | 494/15 |
| 6,988,980 | B2 * | 1/2006 | Moss | B04B 9/12 | 184/6.18 |
| 7,090,634 | B2 * | 8/2006 | Mackel | B04B 9/12 | 384/438 |
| 7,300,396 | B2 * | 11/2007 | Pitkamaki | B04B 9/04 | 494/15 |
| 7,588,526 | B2 * | 9/2009 | Kleimann | B04B 9/12 | 184/6.18 |
| 8,182,408 | B2 * | 5/2012 | Isaksson | B01D 45/14 | 494/70 |
| 8,425,394 | B2 * | 4/2013 | Skytt | B04B 9/12 | 184/6.18 |
| 9,844,786 | B2 * | 12/2017 | Mackel | B04B 7/02 | |
| 2003/0015373 | A1 * | 1/2003 | Stones | F04D 19/046 | 184/6.18 |
| 2004/0192532 | A1 * | 9/2004 | Mackel | B04B 9/12 | 494/15 |
| 2005/0065010 | A1 * | 3/2005 | Moss | F16J 15/42 | 494/15 |
| 2006/0009341 | A1 | 1/2006 | Tobita et al. | | |
| 2006/0276321 | A1 * | 12/2006 | Pitkamaki | B04B 9/04 | 494/15 |
| 2009/0111676 | A1 * | 4/2009 | Kleimann | B04B 9/12 | 494/46 |
| 2009/0186752 | A1 * | 7/2009 | Isaksson | B01D 45/14 | 494/40 |
| 2010/0255976 | A1 * | 10/2010 | Mackel | B04B 9/04 | 494/15 |
| 2010/0273625 | A1 * | 10/2010 | MacKel | B04B 9/04 | 494/15 |
| 2012/0071313 | A1 * | 3/2012 | Mackel | B04B 9/12 | 494/11 |
| 2015/0051059 | A1 * | 2/2015 | Mackel | B04B 15/02 | 494/14 |
| 2015/0283561 | A1 * | 10/2015 | Mackel | B04B 9/04 | 494/10 |

FOREIGN PATENT DOCUMENTS

| | | | |
|---|---|---|---|
| DE | 1 057 979 | B | 5/1959 |
| DE | 39 22 639 | A1 | 2/1990 |
| DE | 43 14 440 | C1 | 6/1994 |
| DE | 10 2006 011 895 | A1 | 9/2007 |
| DE | 10 2006 020 467 | A1 | 10/2007 |
| EP | 0 017 344 | A1 | 10/1980 |
| EP | 215585 | * | 3/1987 |
| EP | 1 617 952 | B2 | 12/2012 |
| FR | 1.287.551 | A | 3/1962 |
| GB | 368247 | A | 3/1932 |
| JP | 50-144367 | U | 11/1975 |
| JP | 55-141563 | U | 10/1980 |
| JP | 61-502007 | A | 9/1986 |
| JP | 62-233041 | A | 10/1987 |
| JP | 7-279975 | A | 10/1995 |
| JP | 2000-352414 | A | 12/2000 |
| JP | 2001-125453 | A | 5/2001 |
| JP | 2006-522679 | A | 10/2006 |
| JP | 2008-138352 | A | 6/2008 |
| JP | 2010-154593 | A | 7/2010 |
| JP | 2011-250668 | A | 12/2011 |
| JP | 2012-512738 | A | 6/2012 |
| WO | WO 85/05157 | A1 | 11/1985 |
| WO | 00/53329 | * | 9/2000 |
| WO | WO 2004/089550 | A1 | 10/2004 |
| WO | WO 2010/071569 | A1 | 6/2010 |

OTHER PUBLICATIONS

German Search Report dated Aug. 20, 2013 with Statement of Relevancy (Six (6) pages).

Singapore Written Opinion in Singapore counterpart application No. 11201503572Q dated Feb. 19, 2016, enclosing Singapore Search Report (Eight (8) pages).

Japanese Office Action issued in Japanese counterpart application No. 2015-541110 dated Nov. 14, 2017, with English translation (Twenty Nine (29) pages).

* cited by examiner

SEPARATOR WITH DIRECT DRIVE AND COOLANT SYSTEM INTEGRATED INTO DRIVE HOUSING

This application claims the priority of International Application No. PCT/EP2013/073117, filed Nov. 6, 2013, and German Patent Document No. 10 2012 110 846.3, filed Nov. 12, 2012, the disclosures of which are expressly incorporated by reference herein.

BACKGROUND AND SUMMARY OF THE INVENTION

The invention relates to a separator.

Separators of this type which are also suitable for an industrial application, especially also in continuous operation, are known from the prior art per se.

The power transmission from the electric motor to the rotor is often carried out via a drive belt or by means of a helical gearing.

Under the known systems there are, furthermore, also constructions in which the drum, the drive spindle and the electric drive motor are rigidly connected to form a modular unit which is then as a whole elastically supported on a machine frame. The generic GB 368 247, FR 1.287.551, DE 1 057 979 and DE 43 14 440 C1 disclose examples of such a prior art. It is disadvantageous that such arrangements are of relatively large construction, especially also in the radial direction (GB 368 247).

In this context, reference is also to be made to EP 1 617 952 which again has embraced the constructional basic principle of GB 368 247, wherein in comparison to GB 368 247 the supporting of the weight of the centrifugal drum is carried out on the neck bearing (upper bearing) and not on the foot bearing (lower bearing). Overall, the constructional design of this separator drive also is still relatively costly, however. Moreover, the type of lubrication and cooling of the electric motor are also still in need of improvement.

Finally, reference is also to be made to DE 513 192 in relation to the prior art. This document discloses a centrifugal spindle in which the drive motor is admittedly arranged in an axial extension of the rotational axis of the centrifugal drum coaxially to this but in which the drive spindle passes through a pipe section, wherein the drive spindle and the pipe section in the case of DE 513 192 are connected in the region of a foot bearing, whereas the pipe section and the drive spindle in a relatively more expensive type of construction have separate neck bearings and only the drive spindle is supported in a radially elastic manner on a machine frame. This type of construction is therefore very costly. The drive housing itself is designed in two parts, wherein an upper part bears on a lower part by means of a flange. There is lubrication with oil but no cooling with a coolant in addition to the lubricant. The stator is fastened directly on the outer circumference of the drive housing.

Overall, the structural design of the known constructions is relatively costly and not adaptable to different application purposes with sufficient flexibility. The cooling of known drive devices, moreover, appears to be worthy of improvement.

In this respect, the modern constructions of DE 10 2006 011 895, DE 10 2006 020 467 A1 constitute a development. Deviating from their construction principle, however, there continues to be a demand for compact separator drives which are easily adaptable to different application purposes and have a perfected and efficient cooling system.

Starting from the known prior art, the invention has in this respect the object of taking another path and to realize a separator which is distinguished by a compact type of construction and especially also by a low maintenance requirement and preferably also an efficient cooling system.

The simple installation and maintenance of the separator drive and also the advantageous cooling system both for the cooling of the motor and of the liquid lubricant which flows back vertically from the top downwards in the drive chamber are to be referred to as being particularly advantageous. Creating a lubricant mist is not necessary with this but lubricating of the bearings of the drive spindle with flowing, liquid lubricant can be used directly so that no lubricant can enter the electric motor itself, which would be unavoidable when using an oil mist system. The rotor is mounted directly on the drive spindle which is radially movable in this region and on the end of which is mounted the drum.

In this case, the cooling system—being a cooling circuit for a cooling fluid, especially water—is preferably and advantageously integrated wholly or partially directly into the drive housing, whereas the electric motor—especially the stator—itself does not have a separate liquid cooling system built into it. In such a way, the electric motor—especially the stator as a preassembled modular unit without a liquid cooling device—can be designed in a particularly cost-effective manner. In addition to cooling with the coolant, there is preferably lubrication with a lubricant. Different liquids are preferably used as the lubricant and the coolant.

Advantageous embodiments are to be gathered from the dependent claims.

The invention is described in more detail below based on exemplary embodiments with reference to the drawings.

DETAILED DESCRIPTION OF THE DRAWINGS

Figure 1:
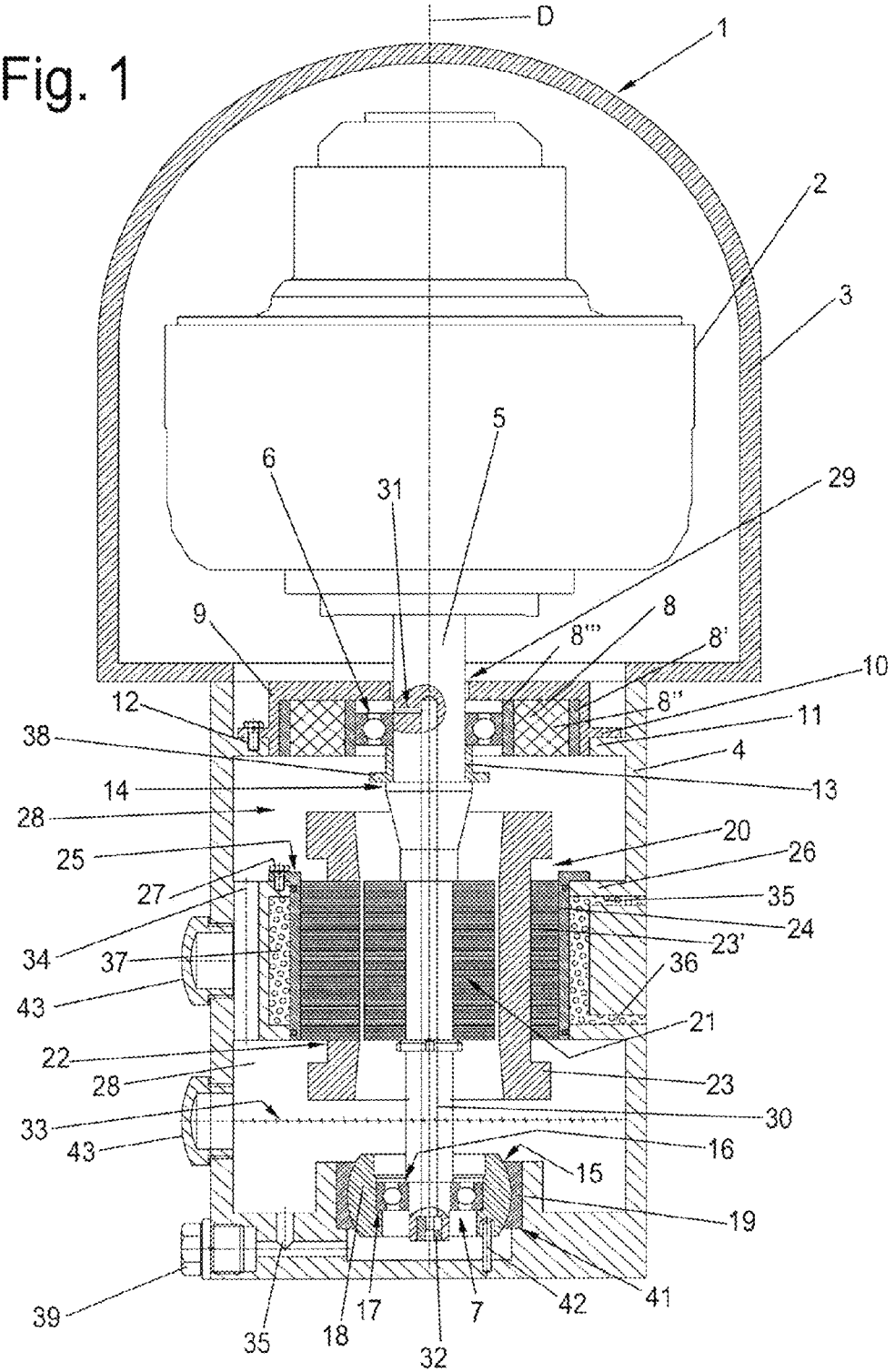
FIG. 1 shows a sectional view of a schematically represented first separator according to the invention.

FIG. 1 shows a separator 1 with a centrifugal drum 2 with a vertical rotational axis D, the separator being enclosed by a hood arrangement 3 which is supported on a machine frame-like drive housing 4. The drive housing 4 can be supported on a foundation, preferably in a sprung design, via foot elements—not shown here.

The centrifugal drum 2 is shown only schematically here. It is preferably designed for a continuous operation for the continuous clarification and/or separation of a free-flowable product in one or two liquid phases and, if necessary, in one solid phase—especially in the industrial process. To this end, its interior space is preferably provided with a separating plate stack. The hood arrangement 3 is also shown only schematically. It can especially have a solid material collector and also one or more lead-throughs for product feed and discharge pipes—not shown here. These features have been known to the person skilled in the art for a long time and do not require a more detailed description here.

The preferably single or double cone centrifugal drum 2 is mounted on the vertical upper end, in this case, of a drive spindle 5. This drive spindle 5 is rotatably mounted by a bearing arrangement which in this case has a neck bearing 6 and a foot bearing 7.

The neck bearing 6 is radially supported, in this case via at least one elastic element, in a bearing housing 9 which in its turn is fastened on the drive housing 4. Here, the bearing housing 9 has a flange section 10 for this purpose which bears on a first—vertically upper—collar 11 on the inner circumference of the drive housing 4 and is fastened there, in this case by circumferentially distributed first screws 12. The bearing housing 9 and the neck bearing preferably and advantageously form a preassembled and exchangeable modular unit. The elastic element consists in this case—also preferably and in a simple type of construction—of two metal sleeves 8', 8''' which are interconnected by means of a ring consisting of elastomer material 8''. The outer ring or the outer sleeve 8' is machined on the outside in this case so that it is guided in the housing in an accurately fitting manner. The elastic element is preferably fixed here, for example pressed in and therefore secured axially and to counteract co-rotation. The inner ring or the inner sleeve 8''' is machined on the inside so that the rolling bearing is preferably movably guided by its outer ring.

Further known alternative constructional forms for this elastic neck bearing support are possible, for example spring pistons with helical springs, leaf springs, pneumatic springs, etc.

The neck bearing 6 is preferably designed as a rolling bearing which in this case rests on a ring 13 which in its turn is seated on the spindle 5 and towards the bottom rests there on a diameter step 14 of the spindle 5. The neck bearing is vertically axially guided and radially supported in the elastic element.

The foot bearing 7 is designed as an axial fixed bearing and is preferably arranged in a rotation-resistant manner on the drive spindle 5. The foot bearing is also arranged in the drive housing 4 via inner ring 18 and outer ring 19 in an articulated, cardanically inclinable but, with regard to the ring 18, non-rotatable manner (articulated element 15) and/or itself is designed like a pivot bearing so that the drive spindle 5 together with the drum can follow the precessional movements of the centrifugal drum 2 during operation.

The resistance to rotation of the foot bearing 7 is achieved here by way of example by means of a pin 42 which is inserted in each case into an opening of the inner ring 18 and of the drive housing.

In this case, the weight of the centrifugal drum together with all the drive parts which are connected to the spindle are supported in the drive housing 4 for the most part via the lower foot bearing 7. Accordingly, use is preferably made here of a rolling bearing which in a suitable manner can absorb the emerging axial forces. Deep groove ball bearings or angular contact ball bearings, for example, are suitable for this. If required, these bearings can also be arranged in pairs if the forces which are to be absorbed require this.

The described pivot bearing undertakes the cardanic inclinability and support in this case.

The entire unit consisting of pivot bearing and rolling bearing, in the event of small forces, especially axial forces, which are to be absorbed can be replaced by a self-aligning bearing or pivot roller bearing.

Towards the top, the foot bearing 7, by its inner circumference, in this case butts against a further diameter step 16 of the drive spindle 5 and towards the bottom, by its outer circumference, butts against a step 17 of an inner ring 18, having a spherical segment-like outer circumference, which inner ring in its turn engages in an articulated manner in a correspondingly complementarily formed outer ring 19 which rests on a step 41 of the drive housing 4.

This arrangement is of compact construction and in a simple and reliable manner enables the supporting of the weight of the centrifugal drum 2 on the drive housing 4 via the foot bearing.

An electric motor 20 with a rotor 21 and a stator 22 is arranged as a drive device in the axial region between the bearings. This lies entirely between the neck bearing 6 and the foot bearing 7.

In this case, the rotor 21 is arranged and fastened directly on the drive spindle. As a result, the rotor 21 and the rotatable drive spindle 5 move together in a fixed coupled manner, especially also during precessional movements of the drive spindle 5 during operation. The drive spindle 5 in this case can have a suitable contouring—e.g. stepping—on its circumference for the fixing or arranging of the rotor 21.

The stator 22 is fixedly connected to the drive housing 4 in this case. In this way, the radial gap width between the stator 22 and the rotor 21 alters during operation as a result of the movements of the drive spindle 5.

The drive spindle 5 admittedly also executes its precessional movement, as a result of centrifugal laws, between the neck bearing 6 and the foot bearing 7 (as a fixed bearing), but this can be definably limited (stop) in this region so that with the aid of a corresponding air gap between the stator 22 and the motor rotor 21 it can be ensured that the rotor 21 and the stator 22 do not come into contact during operation despite radial relative movement. Such relative movements can occur, and possibly have their greatest deflections, for example as a result of unbalanced masses, especially in the range of the resonance frequency of the system when the drum is running up, or for example as a result of movements of the complete machine due to wave influence when being used on board ships.

The support which is formed in the foot bearing 7, designed as a pivot bearing, (which essentially undertakes the axial supporting of the centrifugal drum 2), and in the elastically supported neck bearing 6 advantageously enables a supercritical operation of the motor rotor 21 and the centrifugal drum 2 with regard to the resonance frequency. The mass characteristics of the motor rotor 21 are so small in this case that they do not have a negative effect upon the dynamic behavior of the drive system.

The separator drum together with the spindle and the neck bearing support form in a first approximation a single-mass oscillator which is excited as a result of the rotating drum and especially as a result of the co-rotating unbalanced mass. The elastic neck bearing support significantly lowers its natural frequency in relation to approximately rigid constructions. That rotational speed at which the forces created by the rotating drum and co-rotating unbalanced mass set the machine in resonance oscillations is referred to as the critical rotational speed (or frequency). (The excitation frequency ((drum rotational speed)) is the same as the natural frequency of the system in this case). Above this frequency (rotational speed), the system stabilizes since unbalanced mass and rotor center of gravity lie on opposite sides of the actual rotational axis here. Separators are usually operated with their operational rotational speed significantly above the critical rotational speed (resonance frequency) so that a larger unbalanced mass is also endured by the machine without damaging effects.

Unlike in the case of the prior art, the entire stator 22 together with the winding region 23 with the end windings and the stator plate packets 23' and sleeve body 24, and also the entire rotor 21, are preferably and compactly arranged axially between the neck bearing neck bearing 6 and the foot bearing 7.

For the fastening of the stator 22 on the drive housing 4, it is advantageously provided here to enclose the winding region 23 together with the stator plate packet(s) of the stator 22 by a sleeve body 24 which—preferably at its vertically upper end—has a flange section 25 which butts against, or rests on in this case, a corresponding collar section 26 on the inner circumference of the drive housing 4. For the fastening of the flange section 25 and the collar section 26 provision is made for suitable fastening means, in this case one or more (circumferentially distributed) screws 27.

In the design of the stator, it is primarily particularly advantageous that the stator, simply prefabricated as a preassembled unit, can be fastened in the drive housing by means of the radially outer sleeve body 24.

Figure 2:
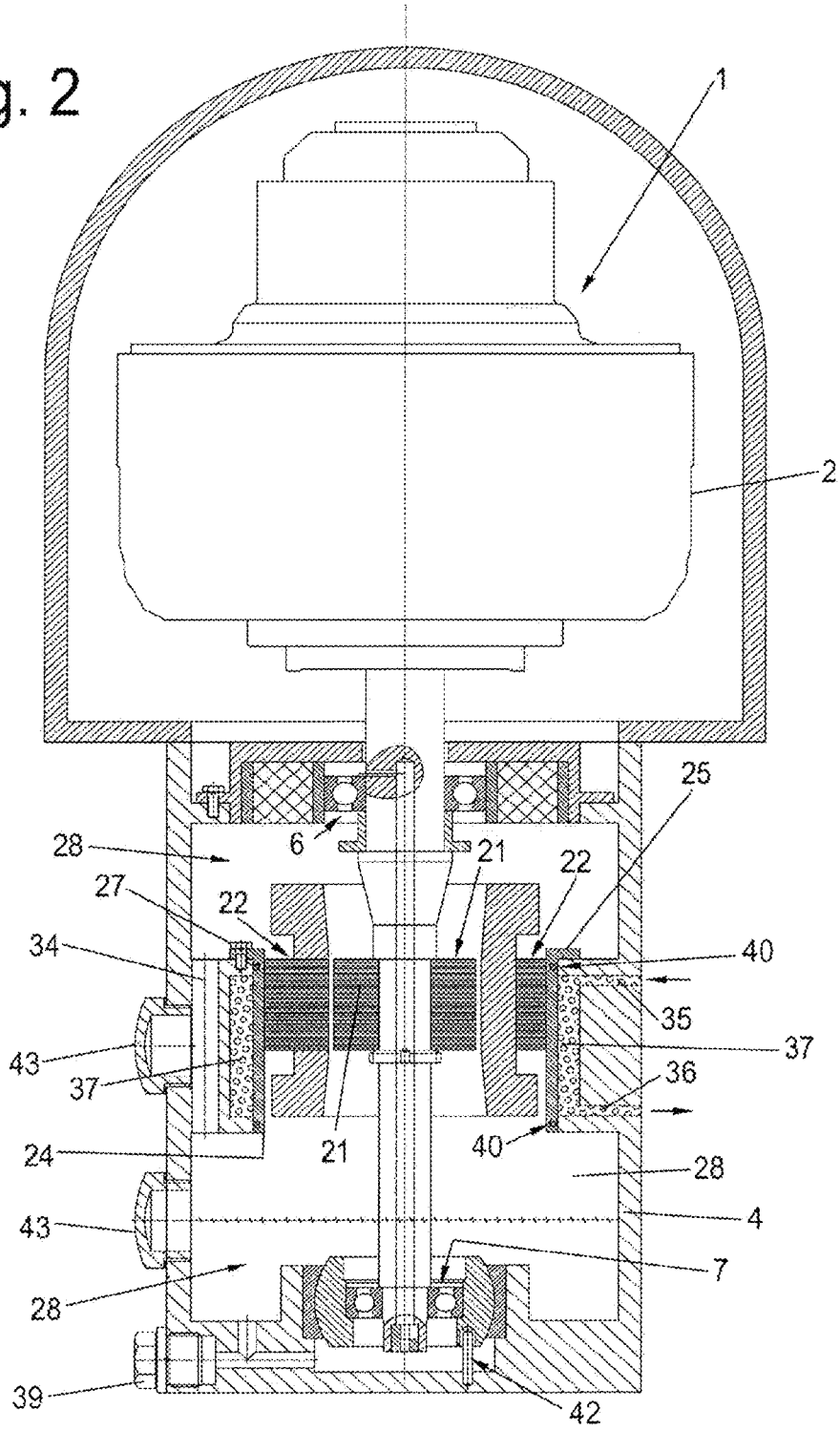
FIG. 2 shows a sectional view of schematically represented second separator according to the invention.

Moreover, on account of the selected type of construction motors (stators 22 and rotors 21) of different length and therefore of different motor capacities can be fastened in a simple manner on the flange section 25, which a comparison of FIGS. 1 and 2 especially also illustrates.

The constructions of FIGS. 1 and 2 are largely structurally the same and in the main differ only by the axial overall length of the electric motors 20 and 20'. As is evident, the axial overall length of the electric motor 20, 20' can vary within a considerable range, which advantageously enables the same drive housings 4 to be used for electric motors 20, 20' of different length and capacity.

A comparison of FIGS. 1 and 2 makes it clear that in the case of stators 22 of different lengths the sleeve body 24 which is used as the interface of the stator 22 to the drive housing 4 has the same vertical overall length, however. Even a sleeve body 24 which is structurally the same is preferably used despite a different vertical length.

The electric motor can be an asynchronous motor or a synchronous motor.

The drive chamber 28 in the upward direction (up to an annular gap 29 for the drive spindle 5 above the neck bearing 6) and in the downward direction, and also to the side, is preferably and advantageously as far as possible a closed design.

If higher quality sealing is required between drive chamber and drum chamber, a labyrinth seal or a corrugated ring seal of known type of construction (not shown here) can be used in addition to the annular gap.

The stator 22 and the rotor or motor rotor 21 are arranged between the neck bearing 6 and the foot bearing 7 in an open manner in the drive chamber 28.

In the constructions of FIGS. 1 and 2, the embodiment of the functional areas of "lubrication" and "cooling of the components of the drive region and of the lubricant" also offer particular advantages.

First of all, the lubrication system may be considered in more detail.

The drive spindle 5 is of hollow design or has an inner central lubricant pipe or hole 30 which extends axially from a region beneath the foot bearing 7, through the region of the rotor 21 of the electric motor 20, into the region of the neck bearing 6 where the lubricant pipe 30, via a radial lubricant feed hole 31, preferably opens into the drive chamber 28, specifically in such a way that lubrication of the neck bearing 6 can be carried out with the lubricant issuing from this hole 31.

The lubricant feed hole 31 therefore preferably opens into the drive chamber above the neck bearing 6. Alternatively, it could also open into the drive chamber 28 just below the neck bearing 6 if as a result of this sufficient lubrication of the neck bearing 6 in ensured.

Integrated into the lower (preferably open) spindle end is in this case a lubricating pump (especially a suction pipe pump or a centrifugal pump; in this case realized with a fin arrangement 32 on the inner circumference of the axial lower end of the lubricant hole 31). The fin arrangement together with the dimensioning of the inlet diameter allows a particularly accurate oil volume control (-adjustment) and, if necessary, can be matched to the lubricant or to the operating conditions, such as the installation location (ambient temperature), and can be of exchangeable design.

Since the lower end of the drive spindle 5 together with the lubricant pump immerse into a lubricant sump 33, lubrication of the neck bearing 6 is carried out in a simple and reliable manner by means of the drive spindle 5 and its pipe 30 and the lubricant feed hole 31.

Lubricant (especially oil) which passes through the neck bearing 6 and lubricates this runs or trickles downward in the drive chamber 28.

It is therefore advantageous that the ring 13 is arranged on the drive spindle 5 beneath the neck bearing 6 between this and the electric motor 20, which ring has a radial collar 38 so that during operation it forms a slinger ring which throws the lubricant in the drive chamber 28 radially outward during rotations of the drive spindle 5, which prevents the lubricant from being able to trickle directly into the electric motor 20. As a result of this, the effect of oil taking the path back into the sump through the gap between the stator 22 and the rotor 21 is prevented. The oil runs downward on the inner wall of the drive housing 4 and through the holes back into the oil or lubricant sump 33. The motor is shown schematically here in a different manner on the left and right of the rotational axis in order to make the understanding easier.

Outside the stator 22, one or more especially vertically extending holes or the like are preferably designed as a lubricant channel 34 in the radially inwardly projecting collar section 26 of the drive housing 4, through which channel the lubricant is directed in the main radially outward past the stator 22 and the motor rotor 11 on its path downward into the lubricant sump 33.

The foot bearing 7 can be located completely beneath the lubricant level in the lubricant sump 33 or can be arranged completely in the lubricant bath.

The end winding temperature as a rule is very high. In this case, these end windings are at a distance which is far to the right of the bearings which is an advantage compared with the prior art. Since the foot bearing 7 lies in the oil sump in this case, it can also be kept cool particularly well. Since the neck bearing 6 is lubricated with flowing lubricating substance, it is, moreover, also cooled better than in the case of an oil mist lubrication system, as is known from the prior art.

In this case, the lubricant can flow back again through further channels/holes 35 into a region of the drive chamber 28 lying beneath the foot bearing 7 in order to be able to enter the pipe 30. As an option, a drain screw 39 enables draining/changing of the lubricant.

The lubricant level preferably lies just below the electric motor 20 without having to come into contact with this.

The heat capacity which results from the losses of the electric motor can be radiated on one side over the surface of the drive housing or a correspondingly designed surface enlargement (e.g. cooling fins on the outer surface of the drive housing 4 over the entire axial length between the neck bearing and the foot bearing 7 in a correspondingly large design). Alternatively or additionally, it is conceivable to direct a coolant through channels and, if necessary, through chambers in the drive housing in order to cool the lubricant.

This coolant preferably and especially advantageously cools both the lubricant and the electric motor (especially the stator 20) in the process.

This is realized in a simple manner here, as follows.

Provision is made in the drive housing of FIGS. 1 and 2 for a coolant feed pipe 35 and a coolant discharge pipe 36 for a cooling liquid or a cooling gas, which open into at least one chamber, preferably an annular chamber 37, which is formed in the drive housing 4 or formed in a constructionally particularly simple and practical manner between the drive housing 4 and sections of the sleeve body 24. Additional components such a coolant pump and possibly a filter for completion of the coolant circuit are not shown here since they are known per se.

In such a way, the lubricant flowing through the lubricant channel 34 is cooled. Furthermore, the stator 20 is also cooled in a particularly effective manner. For the sake of clarification, reference may be made here to FIG. 2.

In FIG. 2, it is evident that the cooling of the electric motor 20 is carried out in the main by means of the chamber, especially the annular chamber of the cooling circuit which is integrated into the drive housing 4.

The actual electric motor, admittedly in this case by the sleeve body 24, also delimits the cooling chamber, in this case the annular chamber 37. However, the motor itself does not have to have a separate cooling system. This simplifies its installation and also the exchange which, moreover, becomes particularly cost-effective as a result of this measure. The stator 22 of the electric motor 20 itself can be provided and exchanged in a particularly simple manner as a prefabricated module. It would also be conceivable to delimit the annular chamber on the inside with an additional sleeve, which, however, is less preferable.

Since the cooling circuit in one region, especially in the region of the chamber, especially the annular chamber 37, is adjacent both to the stator 22—in this case the sleeve body 24—and closely to the at least one of the holes of the lubricant channel which directs the lubricant as a liquid, flowing lubricating substance past the electric motor downward back into the lubricant sump, double cooling is achieved in a simple manner. In this case, one or more seals 40 can be advantageously arranged on the inner circumference of the sleeve body in order to seal the gap between the sleeve body 24 and the collar section 26 (or the cooling chamber). The sleeve body 24 therefore forms one of the walls of the annular chamber 37 in a constructionally particularly simple manner.

Sight glasses 43 in the outer wall allow a visual check especially of the lubricating system, especially since in this case one of the sight glasses lies vertically level with the maximum lubricant level so that the lubricant level can be monitored, wherein a second (upper in this case) sight glass 43 enables the view into lubricant channel 34 and therefore into the oil return.

Since the drive apart from the neck bearing 6 and the foot bearing 7 operates with low wear, a large part of the customary maintenance cost is omitted, which lowers the operating costs.

LIST OF DESIGNATIONS

Separator 1
Centrifugal drum 2
Hood arrangement 3
Drive housing 4
Drive spindle 5
Neck bearing 6
Foot bearing 7
Sleeves 8', 8'''
Elastomer 8''
Bearing housing 9
Flange section 10
Collar 11
Screws 12
Ring 13
Diameter step 14
Articulated element 15
Diameter step 16
Step 17
Inner ring 18
Outer ring 19
Electric motor 20
Rotor 21
Stator 22
Winding region 23
Stator plate packet 23'
Sleeve body 24
Flange section 25
Collar section 26
Screws 27
Drive chamber 28
Annular gap 29
Lubricant pipe 30
Lubricant feed hole 31
Fins 32
Lubricant sump 33
Lubricant channel 34
Channels 35, 36
Annular chamber 37
Radial collar 38
Drain screw 39
Seals 40
Step 41
Pin 42
Sight glasses 43
Rotational axis D

The invention claimed is:

1. A separator, comprising:

a. a centrifugal drum with a vertical rotational axis;

b. a drive spindle, wherein the centrifugal drum is mounted on the drive spindle, wherein the drive spindle is rotatably mounted in a drive housing by a neck bearing and a foot bearing, and wherein the drive housing encloses a drive chamber;

c. an electric motor which has a stator and a motor rotor;

d. wherein the motor rotor is disposed in the drive chamber directly on the drive spindle in an axial region between the foot bearing and the neck bearing;

e. wherein the stator is fixedly connected to the drive housing and wherein an air gap exists between the stator and the motor rotor;

f. wherein the stator and the motor rotor are arranged between the neck bearing and the foot bearing in an open manner in the drive chamber which is closed toward an outside;

g. a lubricating system with a lubricant in a lubricant channel, wherein the lubricating system lubricates the neck bearing and the foot bearing and wherein the lubricating system is wholly or partially integrated directly into the drive chamber; and h. a coolant system with a cooling chamber for a free flowable coolant, wherein the coolant system is wholly or partially integrated into the drive housing and wherein the cooling chamber is disposed between the lubricant channel and the stator such that the coolant in the cooling chamber cools both the lubricant in the lubricant channel and the stator;

i. wherein the stator has a flange section which is disposed on a collar section of the drive housing and wherein the stator has a sleeve body on an outer circumference of the stator;

j. wherein a lubricant sump is disposed in a lower region of the drive chamber and wherein the lubricant is flowable into the lubricant sump from the lubricant channel;

k. wherein the foot bearing during operation is located completely beneath a lubricant level or is disposed completely in the lubricant sump;

l. wherein the neck bearing is disposed in a bearing housing which has a second flange section and wherein the bearing housing and the neck bearing form a preassembled and exchangeable modular unit.

2. The separator as claimed in claim 1, wherein coolant channels are formed in at least one wall of the drive housing and open into the cooling chamber.

3. The separator as claimed in claim 2, wherein the cooling chamber is an annular chamber and is directly adjacent to the lubricant channel and is directly adjacent to the stator.

4. The separator as claimed in claim 1, wherein the stator and the sleeve body form a preassembled, exchangeable modular unit.

5. The separator as claimed in claim 1, wherein the sleeve body in an installed state in the drive housing forms a boundary wall of the cooling chamber.

6. The separator as claimed in claim 1, wherein the flange section is on the sleeve body.

7. The separator as claimed in claim 1, wherein the neck bearing is supported in the drive housing via at least one elastic element and wherein the foot bearing is a pivot bearing or is disposed in the drive housing in an articulated manner such that precessional movements of the centrifugal drum are followable by the drive spindle during operation.

8. The separator as claimed in claim 1, wherein the centrifugal drum and the drive spindle are supported in the drive housing axially via the foot bearing.

9. The separator as claimed in claim 1, wherein the drive spindle is hollow and has an axial inner lubricant pipe which extends from a region beneath the foot bearing, axially through a region of the motor rotor, and into a region of the neck bearing where the lubricant pipe opens into the drive chamber.

10. The separator as claimed in claim 1, wherein a lubricant feed hole opens into the drive chamber above or below the neck bearing.

11. The separator as claimed in claim 1, wherein a lubricant pump is arranged or formed at a lower end of the drive spindle.

12. The separator as claimed in claim 11, wherein the lubricant pump is a centrifugal pump or a suction pipe pump.

13. The separator as claimed in claim 1, wherein a slinger ring is arranged or formed on the drive spindle in an axial region between the neck bearing and the electric motor.

14. The separator as claimed in claim 1, wherein the lubricating system is integrated into the drive chamber as a circulating system.

15. The separator as claimed in claim 1, wherein one or more vertically extending holes are formed as the lubricant channel in the drive housing outside the stator and wherein the lubricant is directable through the one or more holes past the stator and the motor rotor radially outside the stator and the motor rotor.

16. The separator as claimed in claim 1, wherein the lubricant level lies beneath the electric motor during operation.

17. The separator as claimed in claim 1 further comprising one or more sight glasses, wherein the lubricant level and/or the lubricant in the lubricant channel of the lubricating system is visually checkable through the one or more sight glasses.

* * * * *